US006053602A

United States Patent [19]

Noto et al.

[11] Patent Number: 6,053,602

[45] Date of Patent: Apr. 25, 2000

[54] ON-DEMAND MULTI-NOZZLE INK JET HEAD

[75] Inventors: Nobuhiro Noto; Takuji Torii; Yoshitaka Akiyama; Yasuo Takano; Norimasa Kondo; Nobuhiro Kurosawa, all of Hitachinaka, Japan

[73] Assignee: Hitachi Koki Company Ltd., Tokyo, Japan

[21] Appl. No.: 09/127,791

[22] Filed: Aug. 3, 1998

Related U.S. Application Data

[63] Continuation-in-part of application No. 09/031,597, Feb. 27, 1998.

[30] Foreign Application Priority Data

Feb. 28, 1997 [JP] Japan ..... 9-045396
Aug. 1, 1997 [JP] Japan ..... 9-207680

[51] Int. Cl.[7] ..... B41J 2/045
[52] U.S. Cl. ..... 347/70
[58] Field of Search ..... 347/68–71

[56] References Cited

U.S. PATENT DOCUMENTS 3,946,398 3/1976 Kyser et al. ..... 347/70
5,639,508 6/1997 Okawa et al. ..... 347/70

FOREIGN PATENT DOCUMENTS 5-246025 9/1993 Japan .

*Primary Examiner*—John Barlow
*Assistant Examiner*—Craig A. Hallacher
*Attorney, Agent, or Firm*—Whitham, Curtis & Whitham

[57] ABSTRACT

An on-demand multi-nozzle ink jet head includes a diaphragm and a plurality of piezoelectric stacks. The diaphragm forms at least one wall of a pressurizing chamber used to increase the pressure of the ink. When print signals are applied to the piezoelectric stacks. The stacks generate pressure fluctuations in the walls of the pressurizing chamber. An elastic material with adhesive properties is used to bond the diaphragm to the piezoelectric stacks, which elastic material has a Shore hardness of less than 80 on the A scale and less than 30 on the D scale.

13 Claims, 3 Drawing Sheets

ON-DEMAND MULTI-NOZZLE INK JET HEAD

CROSS-REFERENCE TO RELATED APPLICATION

This application is a continuation-in-part application of a Ser. No. 09/031,597 filed Feb. 27, 1998.

BACKGROUND OF THE INVENTION

1. Field of the Invention

The present invention relates to an on-demand multi-nozzle ink jet head using layered piezoelectric elements (hereinafter referred to as "piezoelectric stack"), and more particularly, to an adhesive material for bonding the piezoelectric stack to a diaphragm.

2. Description of the Prior Art

Currently, the most widely used ink jet printing method is the on-demand method, in which ink is ejected only when a print signal is received. Examples of this on-demand method well known in the art include the thermal jet method, which heats the ink directly with a heater and uses air bubbles generated on the surface of the heater to pressurize the ink in a pressurizing chamber, and the piezoelectric method, in which a piezoelectric stack is driven to decrease the internal volume of the pressurizing chamber.

In the piezoelectric method, it is particularly important to establish a satisfactory bond between the piezoelectric stack and the diaphragm to ensure that displacements of the piezoelectric stack are transferred efficiently to the pressurizing chamber. As described in Japanese Patent Application Laid-Open Publication (Kokai) No. SHO-62-73952, for example, mechanical transformations of a piezoelectric stack can be efficiently transferred via the diaphragm to the ink in the pressurizing chamber if the piezoelectric stack is bonded to the diaphragm using an adhesive material with a Shore hardness of 40 or greater on the D scale. Using nozzles with this construction, it is possible to provide a very reliable ink jet head.

An example of a conventional ink jet head is given in FIG. 1. As shown therein, a substrate 19 formed with a groove that corresponds to a channel is joined with a diaphragm 20 to form an ink channel 21 and a nozzle 22. A metal plate 24 is fixed to the diaphragm 20 via an electrically conductive adhesive material 23. On the metal plate 24, are disposed, in order, another layer of the adhesive material 23, a piezoelectric stack 25, a thin film electrode 26, and a solder bump 27.

In order to eject ink during a printing process, a power source 29 applies a drive voltage V0 to the piezoelectric stack 25 via a switch 28. The mechanical transformation generated in the piezoelectric stack 25 and metal plate 24 is transferred in order via the adhesive material 23 and diaphragm 20 to ink 30, thereby forcing the ink 30 outward. This process causes a droplet 31 of ink to be ejected from the nozzle 22 in the ink ejection direction 32. After ink ejection, the piezoelectric stack 25 returns to its original shape, and ink is supplied through the ink supply opening 33 in the ink supply direction 34 to replace the amount of ink that was ejected.

An ink jet head with the construction described above is generally called a Kyser type ink jet head and described in, for example, U.S. Pat. No. 3,946,398. However, if the piezoelectric stack and diaphragm are bonded together using a soft adhesive material, this material will absorb the vibrations of the piezoelectric stack, preventing ink ejection from the nozzle.

This type of ink jet head is typically configured with a plurality of piezoelectric stacks arranged in alignment with one another on a substrate. A plurality of nozzles are formed corresponding to respective ones of the piezoelectric stacks individually. Ink is ejected from the nozzles by displacing the corresponding piezoelectric stacks in the $d_{33}$ direction. If the piezoelectric stacks are bonded to the diaphragm with an adhesive material having a Shore hardness of 40 or greater on the D scale, and neighboring nozzles eject ink droplets at the same time, both corresponding channels are mutually affected by one another and are unable to sufficiently cancel the meniscus vibrations. This effect reduces the speed of the ejected droplets, causing irregularity in the ejection properties, or results in a secondary droplet being ejected after the first. Both of these problems invite a decline in printing quality.

SUMMARY OF THE INVENTION

In view of the foregoing, it is an object of the present invention to provide a multi-nozzle ink jet head capable of quickly reducing the meniscus vibrations after a desirable ink droplet is ejected in order to reduce the mutual interference that effects the driving of neighboring nozzles, thereby preventing a reduction in the quality of ink ejection.

It is another object of the present invention to provide a multi-nozzle ink jet head capable of preventing the ejection of a secondary droplet resulting from residual meniscus vibrations.

These and other objects of the invention will be attained by an on-demand multi-nozzle ink jet head, including pressurizing chambers for increasing the ink pressure; piezoelectric stacks for effecting pressure changes in the pressurizing chambers in response to electric signals; a diaphragm forming at least one wall of the pressurizing chambers; a restrictor forming a channel for supplying ink to the pressurizing chambers; a common ink supply channel for supplying ink to the restrictor; a plurality of nozzles arranged in rows, each nozzle configured with an orifice from which ink droplets are ejected from the pressurizing chamber; and an elastic material having adhesive properties with less than a Shore hardness of 80 on the A scale or 30 on the D scale and used for bonding the piezoelectric stacks to the diaphragm.

Here, the above hardness of 30 is the Shore hardness of 80 on the A scale converted to a D scale value. In the present invention, a silicone resin is desirable for use as the elastic material having slight adhesive properties.

With the construction described above, the meniscus vibrations can be quickly reduced after a desirable ink droplet is ejected, reducing the mutual interference that effects the driving of neighboring nozzles and preventing the ejection of a secondary droplet caused by residual meniscus vibrations.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENT

An on-demand multi-nozzle ink jet head according to a preferred embodiment of the present invention will be described while referring to the accompanying drawings. This ink jet head prints on a recording medium by ejecting ink in response to print signals.

Figure 2:
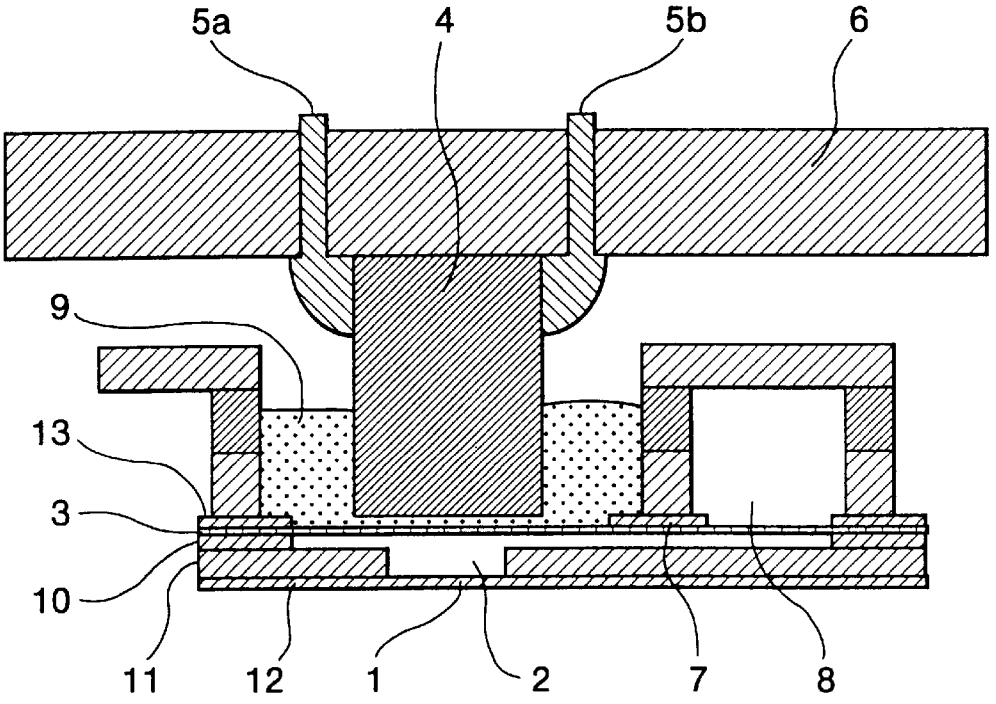
FIG. 2 is a cross-sectional view of a nozzle in an ink jet head according to the present invention.

As shown in FIG. 2, the ink jet head includes an orifice 1; a pressurizing chamber 2; a diaphragm 3; a piezoelectric stack 4 which deforms in the $d_{33}$ direction; a pair of signal input terminals 5*a* and 5*b*; a head substrate 6; an ink channel 8; a restrictor 7 connecting the ink channel 8 and the pressurizing chamber 2 in fluid communication for controlling ink flow into the pressurizing chamber 2; an elastic material 9 bonding the diaphragm 3 and piezoelectric stack 4; a restricting plate 10 for forming the restrictor 7; a chamber plate 11 for forming the pressurizing chamber 2; and an orifice plate 12 for forming the orifice 1. Ink in the ink jet head flows in order through the ink channel 8, restrictor 7, pressurizing chamber 2, and orifice 1.

The piezoelectric stack 4 expands when a positive voltage is applied between the signal input terminals 5*a* and 5*b* wherein the potential on the signal input terminal 5*a* is higher than that on the signal input terminal 5*b*. When the potential difference between the signal input terminals 5*a* and 5*b* becomes zero, the piezoelectric stack 4 returns to its original state before deformation.

The diaphragm 3, restricting plate 10, and chamber plate 11 are constructed of a material such as stainless steel. The orifice plate 12 is constructed of a nickel material. The head substrate 6 is constructed of an insulating material such as ceramics or polyimide, while the electrodes are formed using an electrically conductive paste or by solder plating.

The elastic material 9 is an adhesive material formed of a silicone resin, for example. Specific examples of the elastic material include 3-6611 manufactured by Dow Corning and having a Shore hardness of A-72 or the SE1701 manufactured by Dow Corning Toray Silicone Co., Ltd. and having a Shore hardness of A-71.

Next, the manufacturing method of the multi-nozzle ink jet head of the present invention will be described with reference to FIG. 3.

Figure 3:
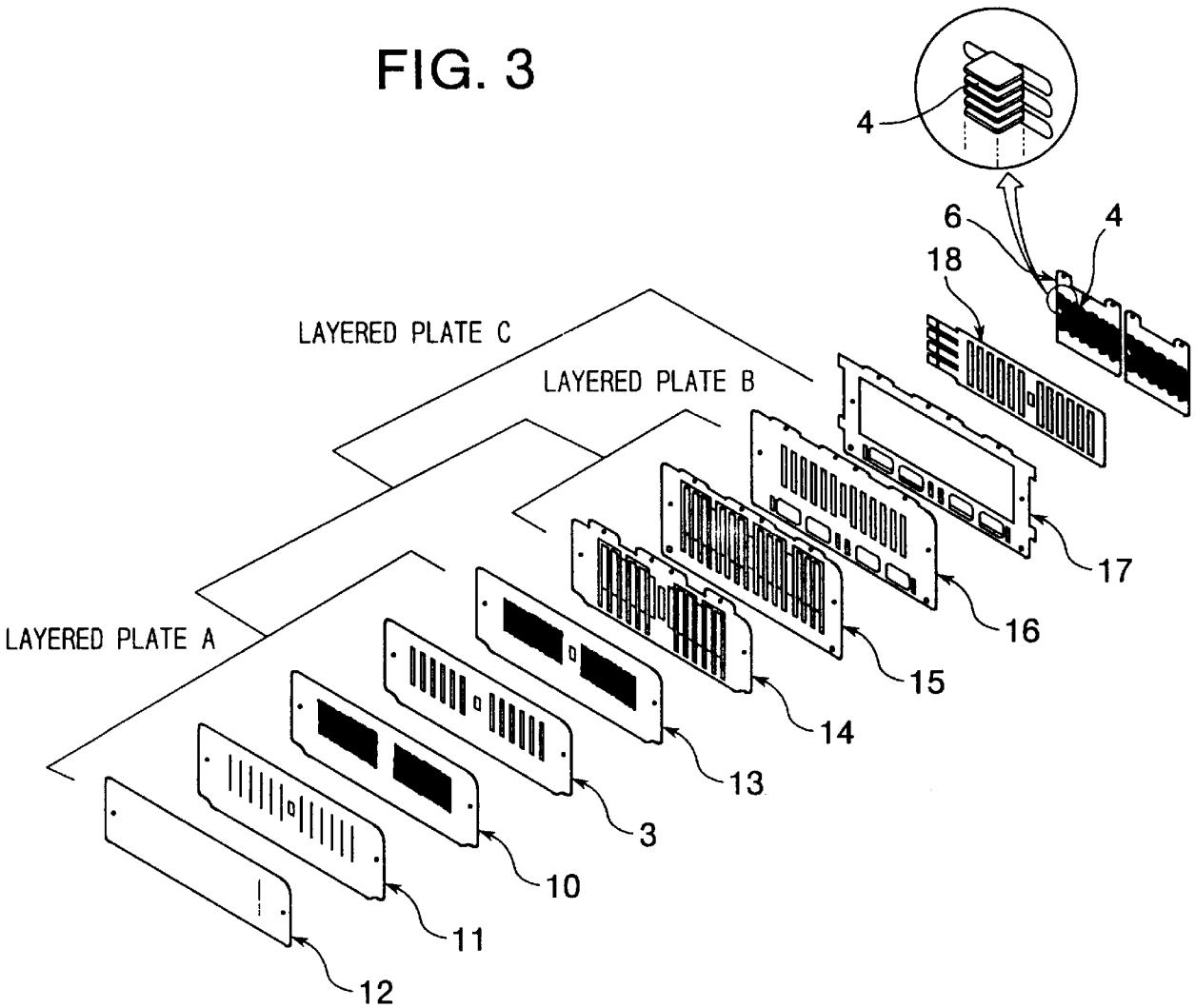
FIG. 3 is a perspective view showing the assembly order of plates in an ink jet head according to the present invention.

FIG. 3 is an exploded view showing the order in which the various plates of the ink jet head are assembled. First, two piezoelectric bars being 36 millimeters in length are arranged on the head substrate 6 parallel to each other and separated by a predetermined distance. The mounting surfaces of the piezoelectric bars are coated with an epoxy-type adhesive and fixed to the head substrate 6. Subsequently, the piezoelectric bars are cut using a dicing saw, wire saw, or the like in order to create plural pieces of piezoelectric stacks having a width of 0.2 millimeters and a nozzle pitch of 0.51 millimeters. 32 pieces of piezoelectric stacks are arranged along a row, wherein each of the cut piezoelectric stacks corresponds with one pressurizing chamber and is designed to drive one nozzle.

Next, the orifice plate 12, chamber plate 11, restricting plate 10, diaphragm 3, and support plate 13 are all joined together to form an assembly which will be referred to as "layered plate A". Then, the common ink channel plate A14, common ink channel plate B15, and common ink channel cover 16 are bonded together to form an assembly which will be referred to as "layered plate B". Layered plates A and B are bonded together and then bonded with a head substrate mounting plate 17. This assembly will be referred to as "layered plate C".

Figure 1:
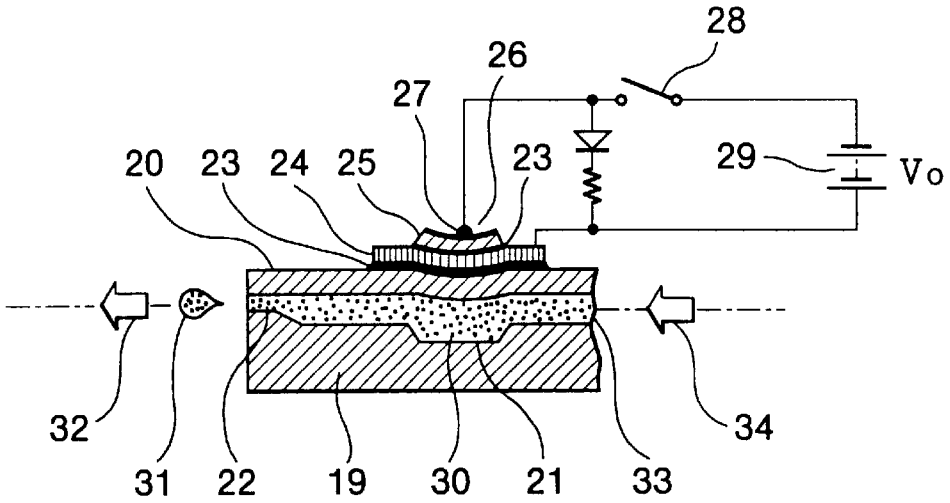
FIG. 1 PRIOR ART
FIG. 1 is a cross-sectional view of a nozzle in a conventional ink jet head.

The elastic material described earlier is coated on the ends of the piezoelectric stacks on the head substrate 6. The head substrate 6 is then assembled with the layered plate C such that the piezoelectric stacks are bonded by the elastic material to the diaphragms 3 corresponding to each pressurizing chamber. Further, the peripheral edges of the head substrate 6 contacting the head substrate mounting plate 17 are fixed with an adhesive which is photocured responsive to ultraviolet rays or with epoxy-type adhesive. The above steps complete the production of a multi-nozzle ink jet head used in the construction of FIG. 1.

Although FIG. 3 shows a heater 18 being fixed to the common ink channel cover 16, the inclusion of this heater assumes the use of a hot-melt ink, which is in a solid form at room temperature and must be melted before ejection. When using ink that retains a liquid form at room temperature, the heater 18 need not be included.

Figure 4:
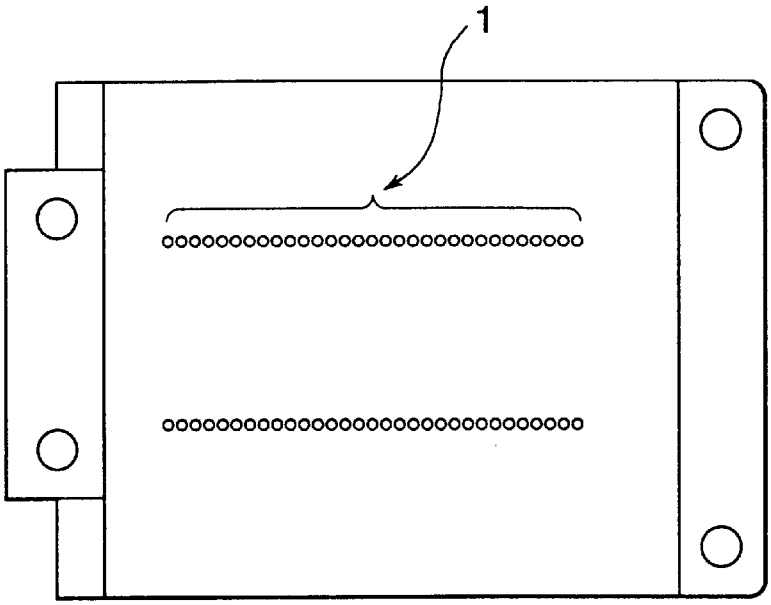
FIG. 4 Is a front view of the nozzle surface in a multi-nozzle ink jet head of the present invention.

FIG. 4 shows the surface of the nozzles in the link jet head of the present invention. The nozzles are arranged in two rows with 32 nozzles in a row, for a total of 64 nozzles.

Table 1 lists the results of testing the ejection properties for an ink jet head with the construction described above, using various adhesive elastic materials to bond the diaphragm 3 and piezoelectric stack 4. Materials used in the tests were selected from among one liquid type adhesives and two liquid type adhesives. The two liquid type adhesive separately uses a main agent and a curing agent, in which the main agent exhibits an adhesive property when the curing agent is added to the main agent. The major component of the main agent is a synthetic resin. The one liquid type adhesive mixes the main agent and the curing agent.

TABLE 1

| One Liquid Type Adhesives | | | | |
|---|---|---|---|---|
| Classification | Model No. | Manufacturer | Hardness (Shore-A) | Secondary Drop |
| Silicon | 3-6611 | Dow Corning | 72 | No |
| Silicon | SE1701 | Dow Corning Toray Silicone Co., Ltd. | 71 | No |
| Silicon | SE1750 | Dow Corning Toray Silicone Co., Ltd. | 71 | No |
| Epoxy | 2286 | Three Bond | 98 | Yes |
| Epoxy | XN1244 | Ciba-Geigy Japan | 99 | Yes |

TABLE 1-continued

| Two Liquid Type Adhesives | | | | | | |
|---|---|---|---|---|---|---|
| Classification | Model No. | Manufacturer | Main Agent | Curing Agent | Hardness (Shore-A) | Secondary Drop |
| Epoxy | EP-001 | Cemedine Co., Ltd. | 50 | 100 | 71 | No |
| Epoxy | EP-001 | Cemedine Co., Ltd. | 100 | 100 | 78 | No |
| Epoxy | EP-001 | Cemedine Co., Ltd. | 100 | 50 | 87 | Yes |
| Epoxy | EP-001 | Cemedine Co., Ltd. | 100 | 25 | 99 | Yes |

The driving conditions used in the tests described above include a pulse width of 8 μs, a drive frequency of 2 kHz, and an ink droplet speed of 13 m/s. The ink used was a hot-melt ink. The ink jet head was heated to 130° C.

As can be seen from Table 1, a secondary droplet is not generated when the Shore hardness is less than 80 on the A scale. This indicates that, when the adhesive material has a Shore hardness less than A-80, the effects from ejecting the first ink droplet do not linger, and the meniscus vibrations in the ink are sufficiently attenuated. Measurements to obtain the values for Shore hardness in the table were conducted at room temperature, but all of the materials tested can be used at 130° C.

Figure 5:
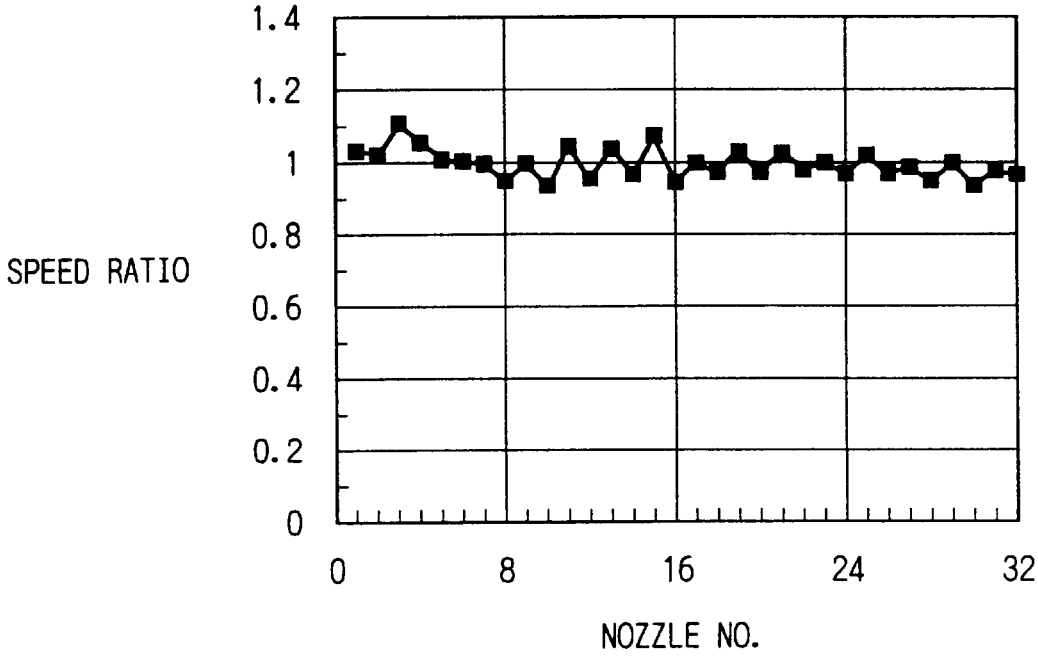
FIG. 5 is a graph showing results of measuring the cross-talk for an ink jet head of the present invention.

The cross-talk was measured for an ink jet head using the 3-6611 adhesive manufactured by Dow Corning (Shore hardness of A-72), which is one of the silicone resin adhesives that did not generate a secondary drop during the tests. The results of the measurements are shown in FIG. 5. For the measurements, 16 odd nozzles and 16 even nozzles were driven at timings separated by an interval of 50 μs. The nozzles were driven with a pulse width of 8 μs, a driving frequency of 10 kHz, and a fixed voltage of 30 V for all nozzles. In the graph of FIG. 5, the X-axis shows the nozzle number, while the Y-axis represents the ratio of the speed when driving 32 nozzles divided into two groups of 16 even and 16 odd nozzles to the speed when driving the nozzles independently.

Here, the closer the speed ratio is to 1, the less influence is being felt by ejection of neighboring nozzles. However, since most of the nozzles have a speed ratio nearly equal to one, it is obvious that the ink jet head of the present invention can reduce the influence of cross-talk. This reduction is made possible by the elastic material bonding the diaphragm and the piezoelectric stack together. The elastic material efficiently attenuates the meniscus vibrations generated when an ink droplet is generated by the application of a print signal.

Hence, it is possible to achieve reliable ink droplet ejection properties without the generation of secondary droplets by bonding the diaphragm and piezoelectric stack in an ink jet head as described above using an elastic material with a Shore hardness of less than 80 on the A scale and less than 30 on the D scale. Accordingly, with this construction it is possible to maintain reliable printing quality.

In the ink jet head of the present invention, an elastic material with a Shore hardness of less than 80 on the A scale and less than 30 on the D scale is used to bond the diaphragm with the piezoelectric stack to attenuate the influence of cross-talk by rapidly reducing the residual meniscus vibrations. In addition, it is possible to achieve a high printing quality by reducing disparities in the point at which ink is deposited on the recording material and by preventing the generation of secondary droplets.

What is claimed is:

1. An on-demand multi-nozzle ink let head, comprising:

walls and a diaphragm defining a predetermined number of pressurizing chambers that are filled with ink;

a predetermined number of piezoelectric stacks attached to the diaphragm so as to be in one-to-one correspondence with the predetermined number of pressurizing chambers, each of the predetermined number of piezoelectric stacks having a pair of input terminals to which an electric signal is applied and being deformed in response to the electric signal, causing pressure in a corresponding pressurizing chamber to increase; and an elastic adhesive material that bonds the predetermined number of piezoelectric stacks to the diaphragm, the elastic adhesive material having a Shore hardness of less than 80 on an A scale or less than 30 on a D scale.

2. The on-demand multi-nozzle ink jet head according to claim 1, wherein the Shore hardness of the elastic adhesive material is substantially in a range from 70 to 80 on the A scale.

3. The on-demand multi-nozzle ink jet head according to claim 1, wherein the elastic adhesive material comprises a silicone resin.

4. The on-demand multi-nozzle ink jet head according to claim 1, wherein each of the predetermined number of piezoelectric stacks deforms in a direction in which an ink droplet is ejected.

5. The on-demand multi-nozzle ink jet head according to claim 4, wherein each of the predetermined number of piezoelectric stacks deforms in a direction of $d_{33}$.

6. The on-demand multi-nozzle ink jet head according to claim 1, wherein the elastic adhesive material is a one liquid type adhesive that is mixed with a main agent and a curing agent.

7. The on-demand multi-nozzle ink jet head according to claim 1, wherein the elastic adhesive material is a two liquid type adhesive including a main agent and a curing agent wherein the main agent exhibits adhesive property when the curing agent is added to the main agent.

8. The on-demand multi-nozzle ink jet head according to claim 7, wherein a major component of the main agent is a synthetic resin.

9. An on-demand multi-nozzle ink jet head, comprising:

walls and a diaphragm defining a predetermined number of pressurizing chambers that are filled with ink;

a predetermined number of piezoelectric stacks attached to the diaphragm so as to be in one-to-one correspondence with the predetermined number of pressurizing chambers, each of the predetermined number of piezoelectric stacks having a pair of input terminals to which an electric signal is applied and being deformed in response to the electric signal, causing pressure in a corresponding pressurizing chamber to increase; and an adhesive material that bonds the predetermined number of piezoelectric stacks to the diaphragm, the adhesive material being such a material that has a Shore hardness not causing generation of a secondary ink droplet following a first ink droplet generated in response to the electric signal.

10. The on-demand multi-nozzle ink jet head according to claim 9, wherein the elastic adhesive material comprises a silicone resin.

11. The on-demand multi-nozzle ink jet head according to claim 9, wherein each of the predetermined number of piezoelectric stacks deforms in a direction in which an ink droplet is ejected.

12. The on-demand multi-nozzle ink jet head according to claim 11, wherein each of the predetermined number of piezoelectric stacks deforms in a direction of $d_{33}$.

13. A method for making an on-demand multi-nozzle ink jet head with improved print quality, comprising:

forming an array of ink jet nozzles on a substrate, said nozzles each including a pressurizing chamber for holding a supply of ink, said pressurizing chamber including an orifice for ejecting an ink droplet and having a wall formed from a diaphragm;

for each of said nozzles, bonding a piezoelectric stack onto a surface of said diaphragm using an elastic adhesive material, said piezoelectric stack having electrodes for receiving electrical signals which cause said piezoelectric stack to deform said diaphragm inwardly into the pressurizing chamber; and selecting said elastic adhesive material to have a Shore hardness of less than 80 on an A scale or less than 30 on a D scale, said Shore hardness causing said elastic adhesive material to reduce meniscus vibrations between adjacent ones of said nozzles during operation of said ink jet head.

* * * * *